US008695976B2

(12) United States Patent
Takahata et al.

(10) Patent No.: US 8,695,976 B2
(45) Date of Patent: Apr. 15, 2014

(54) SHEET CONVEYOR DEVICE

(75) Inventors: Muneaki Takahata, Toyoake (JP); Yoshinori Osakabe, Seto (JP); Katsuro Miura, Toyota (JP); Takashi Ohama, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/611,905

(22) Filed: Sep. 12, 2012

(65) Prior Publication Data

US 2013/0256981 A1 Oct. 3, 2013

(30) Foreign Application Priority Data

Mar. 30, 2012 (JP) ..... 2012-081047

(51) Int. Cl.
*B65H 39/10* (2006.01)

(52) U.S. Cl.
USPC ..... 271/303; 271/301

(58) Field of Classification Search
USPC ..... 271/301, 302, 303, 65
See application file for complete search history.

(56) References Cited

U.S. PATENT DOCUMENTS

| | | | | | |
|---|---|---|---|---|---|
| 3,860,339 | A | * | 1/1975 | Bendall | 399/364 |
| 3,865,482 | A | * | 2/1975 | Bendall et al. | 399/364 |
| 4,750,016 | A | * | 6/1988 | Kusumoto et al. | 399/405 |
| 5,095,370 | A | * | 3/1992 | Takada et al. | 358/300 |
| 5,331,386 | A | * | 7/1994 | Mizubata et al. | 399/82 |
| 6,131,902 | A | * | 10/2000 | Takenaka et al. | 271/303 |
| 6,678,076 | B1 | | 1/2004 | Hasegawa et al. | |
| 6,714,326 | B1 | * | 3/2004 | Yamada | 358/498 |
| 7,731,352 | B2 | * | 6/2010 | Yonekawa | 347/108 |
| 7,758,182 | B2 | * | 7/2010 | Yonekawa | 347/108 |
| 8,219,020 | B2 | * | 7/2012 | Ito | 399/405 |
| 8,287,122 | B2 | * | 10/2012 | Yonekawa et al. | 347/108 |
| 2011/0199654 | A1 | | 8/2011 | Takata | |

FOREIGN PATENT DOCUMENTS

| | | | |
|---|---|---|---|
| JP | 2000128413 | A | 5/2000 |
| JP | 2007049300 | A | 2/2007 |
| JP | 2011171957 | A | 9/2011 |

* cited by examiner

*Primary Examiner* — Kaitlin Joerger
(74) *Attorney, Agent, or Firm* — Banner & Witcoff, Ltd.

(57) ABSTRACT

A sheet conveyor device may include a first portion configured to move, a cam configured to move in response to movement of the first portion, and a guide portion configured to move between first and second positions in response to the movement of the cam, to choose a first or second conveying path for a sheet. The cam may cause the guide portion to remain in position even if the first portion is moved a small amount, thereby helping to reduce the likelihood of paper jams arising from undesired movement of the guide portion.

15 Claims, 13 Drawing Sheets

65
54
53
5
55
53
54
65
44A
S2
44A
51
S3
44A
S2
51D
51C
51D
51C
51
51D
51C
S3
51C
51E
51C
51E
51C
51E
51
REAR
LEFT
RIGHT
FRONT

SHEET CONVEYOR DEVICE

CROSS-REFERENCE TO RELATED APPLICATION

This application claims priority from Japanese Patent Application No. 2012-081047, filed on Mar. 30, 2012, which is incorporated herein by reference.

FIELD OF DISCLOSURE

The disclosure relates to a sheet conveyor device.

BACKGROUND

There has been known an automatic document feeder ("ADF") equipped in an image-reading device and a sheet conveyor mechanism equipped in an image forming apparatus (hereinafter, there are referred to as a sheet conveyor device).

A known sheet conveyor device is configured to switch a conveying path to be used among a plurality of conveying paths in accordance with a thickness of a sheet to be conveyed. For example, in the known sheet conveyor device equipped in an image-reading device, a conveying path including a substantially U-shaped part in which a conveying direction of a document is reversed such that the document is substantially U-turned (hereinafter, referred to as a first conveying path) is used when a cover is closed. When the cover is opened, a conveying path through which a document is conveyed without being warped hardly (hereinafter, referred to as a second conveying direction) is used. The known sheet conveyor device is configured to convey a document without the cover being opened in most cases. When the cover is opened, the sheet conveyor device is configured to convey a relatively-thick tear-resistant sheet or a sheet to be damaged due to warping.

The known sheet conveyor equipped in the image-reading device includes a movable guide portion near a first conveyor roller pair disposed inside the cover. When the cover is closed, the movable guide portion is located at a position where an tip of the movable guide portion points diagonally downward (hereinafter, referred to as a first position). In this state, a sheet conveyed by the first conveyor roller pair is made contact with the movable guide portion and is further conveyed to the U-shaped part of the conveying path with being guided by a contact surface of the movable guide portion.

When the cover is opened, the movable guide portion is located at a position where the tip of the guide portion points diagonally upward (hereinafter, referred to as a second position). In this state, the sheet conveyed by the first conveyor roller pair is discharged onto an upper surface of the cover without being made contact with the movable guide portion.

As described above, the movable guide portion is configured to move between the first position and the second position in accordance with the opening or closing of the cover. Therefore, the sheet conveyor device may provide higher convenience as compared with a sheet conveyor device including a cover and a movable guide portion that are configured to be moved independently without synchronization.

However, the following problems may arise when the movement of a portion that may be openable like the above-described cover (hereinafter, referred to as an openable portion) and the movement of the movable guide portion are simply synchronized. That is, in the sheet conveyor device in which the openable portion and the movable guide portion are configured to be moved in synchronization with each other, the movable guide portion may be slightly moved toward the second position from the first position when the openable portion is slightly opened. Under this condition, when a sheet is conveyed from an upstream in the conveying path, the sheet may be made contact with the movable guide portion but may not be guided to an appropriate direction. As a result, a problem, for example, a paper jam, may occur in the conveying path.

When the openable portion rattles in some degree due to variations in assembling accuracy within tolerances, the movable guide portion may rattle due to the rattling of the openable portion. In this case, the movable guide portion may be moved toward the second position from the first position in accordance with an amount of rattling of the guide portion. In this case, also, a problem, for example, a paper jam, may occur in the conveying path.

Therefore, some arrangement may need to be adapted to avoid or reduce the above problem for synchronizing the movements of the openable portion and the movable guide portion. However, a detailed configuration for synchronizing the openable portion (the cover) and the guide portion in the known sheet conveyor may be unknown.

SUMMARY

In some embodiments described herein, a first portion may be configured to be moved, and a cam may be configured to pivot about an axis in response to movement of the first portion. The cam may comprise a first cam surface that extends along a direction of the axis while maintaining a constant distance from the axis. A guide portion may be configured to be movable between a first position and a second position, in response to movement of the cam, to choose a first or second conveying path for the sheet, wherein when the guide portion is in the first position, the guide portion is in contact with the first cam surface.

Embodiments of the disclosure provide for a sheet conveyor device in which a guide portion is moved in accordance with movement of a first portion, but the guide portion is not moved by a slight movement of the first portion.

In some embodiments, the sheet conveyor device may further comprise an urging member configured to urge the guide portion toward the second position, wherein the cam allows the guide portion to locate in the first position against an urging force of the urging member when the first cam surface is located in the position where the first cam surface is in contact with the guide portion. In some embodiments, the cam further comprises a second cam surface that extends along the direction of the axis while maintaining a constant distance, which is different from the constant distance between the first cam surface and the axis, from the axis, and is configured to retain the guide portion in the second position when the cam is located in a position where the second cam surface is in contact with the guide portion.

In some embodiments, the guide portion comprises a guide surface configured to allow the sheet being conveyed along the first conveying path to move from upstream to downstream in a conveying direction when the guide portion is located in the first position, wherein the cam is further configured to contact the guide portion at a position closer to a downstream end of the guide surface than an axis of the guide portion.

In some embodiments, the sheet conveyor device is configured to convey the sheet through the second conveying path with the sheet to be less warped than the sheet to be conveyed through the first conveying path. The first conveying path may further comprise a curved part in which the sheet conveyor device conveys the sheet from the upstream to the downstream while causing the sheet to become warped, wherein the guide portion is disposed upstream of the curved part of the first conveying path and configured to allow the sheet to move along the curved part of the first conveying path. The conveyor may further comprise a conveyor roller that is disposed on a side opposite to a side where the guide portion is disposed while interposing the conveying path therebetween and configured to contact the sheet by a circumference of the conveyor roller curving along the curved part, wherein the guide portion is configured to be pivotable about an axis located below a rotation axis of the conveyor roller with respect to an up-down direction.

In some embodiments, the first portion can cause the cam to move, and can block a part of the second conveying path when the first portion is in a first position, and define a part of the second conveying path when the first portion is in a second position.

In some embodiments, the first cam surface allows the cam to be rotated a predetermined amount without causing the guide portion to move between the first and second positions, and can cause the guide portion to move between the first and second positions when the cam is rotated beyond the predetermined amount.

The cam may be interlocked with the first portion, and the first portion may be a transmission arm interlocked with a cover. The cover may define a part of the second conveying path. The cam can also include an extended portion coupled to the first portion via a second axis. The cam may have a cross-section in the shape of a circle with a protrusion corresponding to a first cam surface, and the cross-section of the protrusion may be curved in an upstream direction.

In some embodiments, the sheet conveyor device may include a conveyor configured to convey a sheet; an openable portion configured to be opened or closed; a guide portion configured to allow the sheet being conveyed by the conveyor to move along a first conveying path when the guide portion is located in a first position; and allow the sheet being conveyed by the conveyor to move along a second conveying path when the guide portion is located in a second position, wherein the openable portion blocks a part of the second conveying path when the openable portion is closed; and a cam configured to move the guide portion between the first and second positions in response to movement of the openable portion, wherein an exterior of the cam, when viewed in cross-section, includes a first cam surface having a first radial distance from a pivot axis of the cam, and a second cam surface having a second radial distance from the pivot axis of the cam, wherein the second radial distance is less than the first radial distance.

In some embodiments, a sheet conveyor method may include using a cam to transmit motion of an openable portion to a guide portion to move the guide portion between first and second positions, wherein the first and second positions correspond to first and second sheet conveying paths; allowing the cam to rotate a predetermined amount without moving the guide portion from a first position to a second position; and moving the guide portion from the first position to the second position in response to the cam rotating beyond the first amount. The method can also include using a transmission portion to transmit movement from the openable portion to the cam.

Therefore, for example, although the openable portion is slightly moved toward the opened position, the guide portion may not be moved from the first position immediately. In addition, the guide portion may not be moved from the first position due to variations in assembling accuracy within tolerances. Thus, an occurrence of a paper jam caused by the undesired movement of the guide portion may be reduced in the first conveying path.

DESCRIPTION OF THE DRAWINGS

For a more complete understanding of the present disclosure, needs satisfied thereby, and the objects, features, and advantages thereof, reference now is made to the following descriptions taken in connection with the accompanying drawing.

FIG. 10 B is an enlarged plan view depicting an area S2 depicted in FIG. 10A in the illustrative embodiment according to one or more aspects of the disclosure.

DETAILED DESCRIPTION OF EMBODIMENTS

Figure 1A:
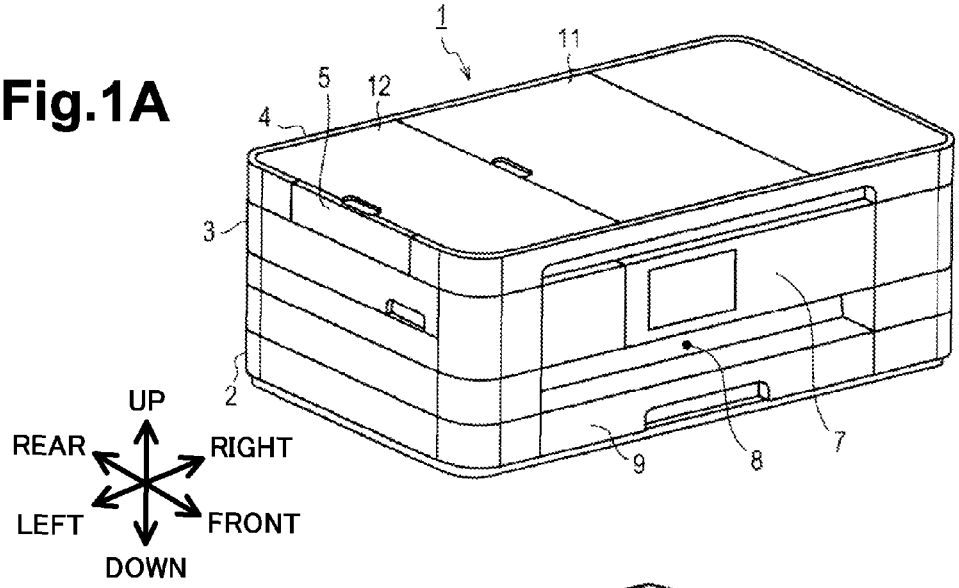
FIG. 1A is a perspective view depicting a multifunction peripheral wherein a document conveyor unit is located in a closed position in an illustrative embodiment according to one or more aspects of the disclosure.

Illustrative embodiments are now described in detail with reference to the accompanying drawings. A sheet conveyor device according to one or more aspects of the disclosure may serve as an automatic document feeder ("ADF") equipped in an image-reading device. The image-reading device according to the one or more aspects of the disclosure may serve as a multifunction peripheral that has various functions, e.g., a printing function, a copying function, and a facsimile data transmitting/receiving function, as well as a scanning function, which is a function of the image-reading device. Hereinafter, description is made with reference to directions, e.g., up, down, right, left, front and rear, as shown in the drawing of FIG. 1A in order to explain relative positional relationships among each unit that the multifunction peripheral may comprise.

Figure 1B:
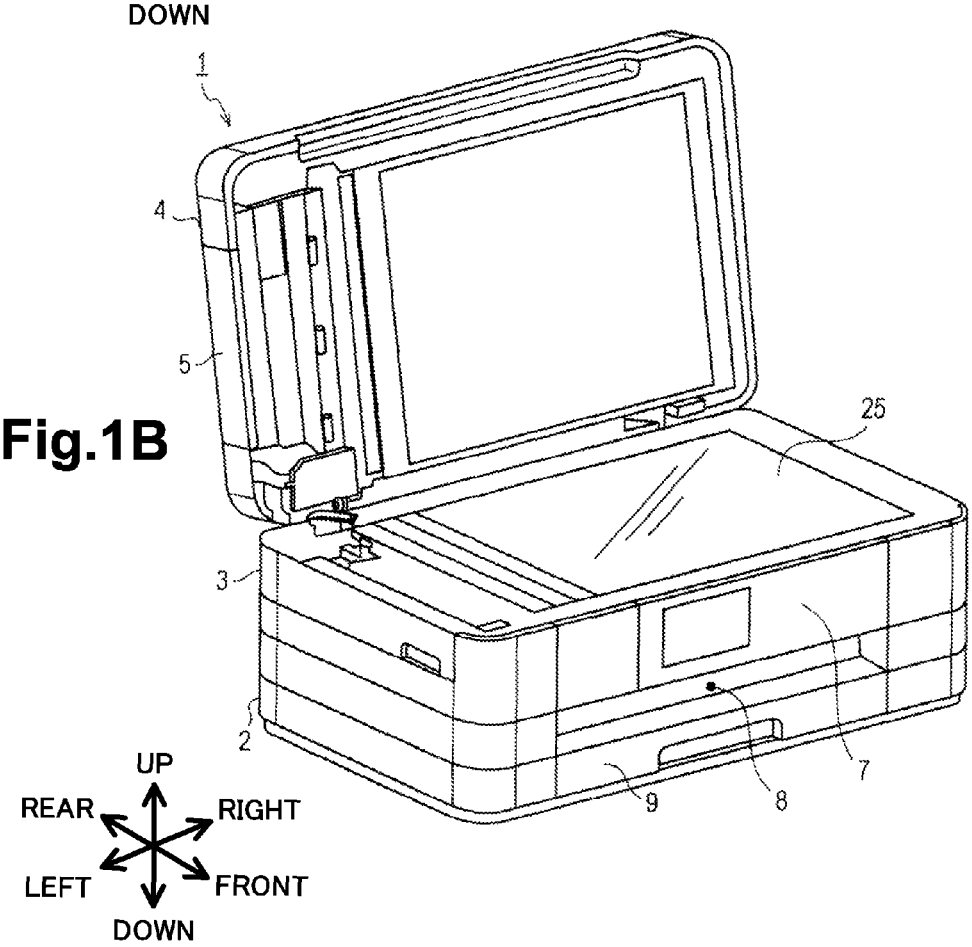
FIG. 1B is a perspective view depicting the multifunction peripheral wherein the document conveyor unit is located in an opened position in the illustrative embodiment according to one or more aspects of the disclosure.

As depicted in FIGS. 1A and 1B, a multifunction peripheral 1 may comprise a main unit 2, a reading unit 3, and a document conveyor unit 4 (an example of a sheet conveyor device). The reading unit 3 may be disposed above the main unit 2. The document conveyor unit 4 may be disposed above the reading unit 3.

The main unit 2 may comprise an image forming portion, a control device, and a power source device, for example. The control device may be configured to control mechanisms disposed in the main unit 2, the reading unit 3, and the document conveyor unit 4.

The reading unit 3 may be configured to be pivotable about an axis, which may extend along a right-left direction near rear edges of the main unit 2 and reading unit 3, with respect to the main unit 2. When a forward part of the reading unit 3 is moved upward by pivoting the reading unit 3, an upper opening of the main unit 2 may appear, and this condition may allow maintenance of each unit or each portion (for example, the image forming portion, the control device, and the power source device) disposed inside the main unit 2 to be performed.

The document conveyor unit 4 may be configured to be pivotable about an axis, which may extend along the right-left direction near rear edges of the reading unit 3 and the document conveyor unit 4, with respect to the reading unit 3. The document conveyor unit 4 may be configured to be movable between a closed position (see FIG. 1A) and an opened position (see FIG. 1B) in accordance with the pivoting of the document conveyor unit 4.

When the document conveyor unit 4 is located in the opened position, a document receiving surface may appear at an upper surface of the reading unit 3. When the document conveyor unit 4 is located in the closed position, the document conveyor unit 4 may serve as a cover that may cover the document receiving surface.

The document conveyor unit 4 may comprise an openable portion 5 that may define a left side-surface of the document conveyor unit 4. The openable portion 5 may be configured to be pivotable about an axis, which may extend along a front-rear direction near left lower edges of the document conveyor unit 4 and the openable portion 5, which respect to the document conveyor unit 4. An opening and closing mechanism of the openable portion 5 will be described in detail later.

The main unit 2 may comprise a control panel 7 at an upper front part of the main unit 2. The control panel 7 may be configured to be operated by a user. The main unit 2 may further comprise a sheet feed cassette 9 at a lower part of the main unit 2. The sheet feed cassette 9 may be configured to accommodate one or more recording media on which printing is to be performed. The main unit 2 may have a sheet discharge port 8 above the sheet feed cassette 9. A recording medium on which printing is performed may be discharged from the discharge port 8.

Figure 2:
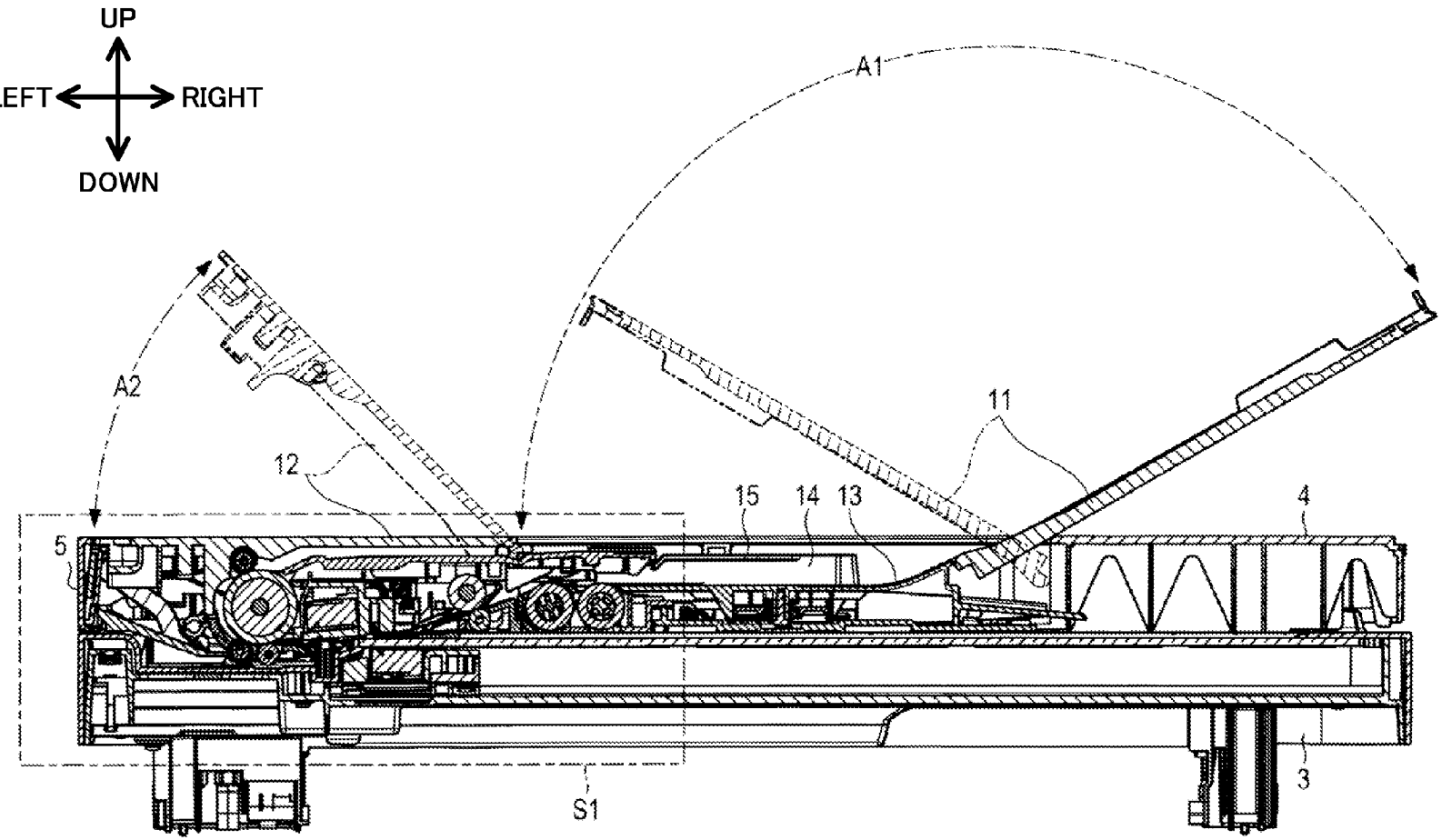
FIG. 2 is a longitudinal sectional view depicting an internal configuration of the document conveyor unit and a reading unit in the illustrative embodiment according to one or more aspects of the disclosure.

As depicted in FIG. 1A, the document conveyor unit 4 may further comprise a first upper cover 11 and a second upper cover 12 that may define an upper surface of the document conveyor unit 4. As depicted by a double-headed arrow A1 in FIG. 2, the first upper cover 11 may be configured to be pivotable about an axis, which may extend along the front-rear direction near a right edge of the first upper cover 11, with respect to the document conveyor unit 4. Similar to the first upper cover 11, as depicted by a double-headed arrow A2 in FIG. 2, the second upper cover 12 may be configured to be pivotable about an axis, which may extend along the front-rear direction near a right edge of the second upper cover 12, with respect to the document conveyor unit 4.

When the first upper cover 11 is located in a closed position, the first upper cover 11 may extend leftward from the vicinity of the center of the pivot and cover a sheet passing surface 13 that may be present under the first upper cover 11. When the first upper cover 11 is located in an opened position, the first upper cover 11 may extend right upward from the center of the pivot and serve as a document receiving surface together with the sheet passing surface 13.

A pair of side guides 14 may be disposed on the sheet passing surface 13. The pair of side guides 14 may be configured to be slidable along the front-rear direction. In accordance with the sliding of one of the side guides 14, the other of the side guides 14 may slide along a direction reverse to a direction that the one of the side guides 14 may slide. Therefore, the side guides 14 may be allowed to slide along directions that they may get closer to each other or they may be separated from each other for changing a distance between the side guides 14 by which one of the side guides 14 may be moved toward a desired direction.

Each of the side guides 14 may comprise a partition 15. The partition 15 may be a plate-shaped member that may extend from an upper edge of each side guide 14 toward each other. One or more documents to be conveyed may be placed under the partitions 54 of the side guides 14. Under this condition, the side guides 14 may be made contact with side edges, which may extend parallel to a document conveying direction, of the one or more documents to restrict the document conveying direction.

The document conveyed along a first conveying path (described later) may be discharged above the partitions 15 of the side guides 14. Then, the document may be further conveyed to an area that may extend between the sheet passing surface 13 and the first upper cover 11. That is, in the multifunction peripheral 1, the area that may extend between the sheet passing surface 13 and the first upper cover 11 may be used as the document receiving surface that may receive one or more documents to be conveyed and the one or more discharged documents that have been conveyed.

When the second upper cover 12 is located in a closed position, the second upper cover 12 may extend leftward from the vicinity of the center of the pivot and cover a portion that may be present under the second upper cover 12, similar to the first upper cover 11. When the second upper cover 12 is located in an opened position, a document conveying path that may be present under the second upper cover 12 may be exposed. In this state, a document jammed in the document conveying path under the second upper cover 12 may be allowed to be removed when a paper jam occurs.

Figure 3:
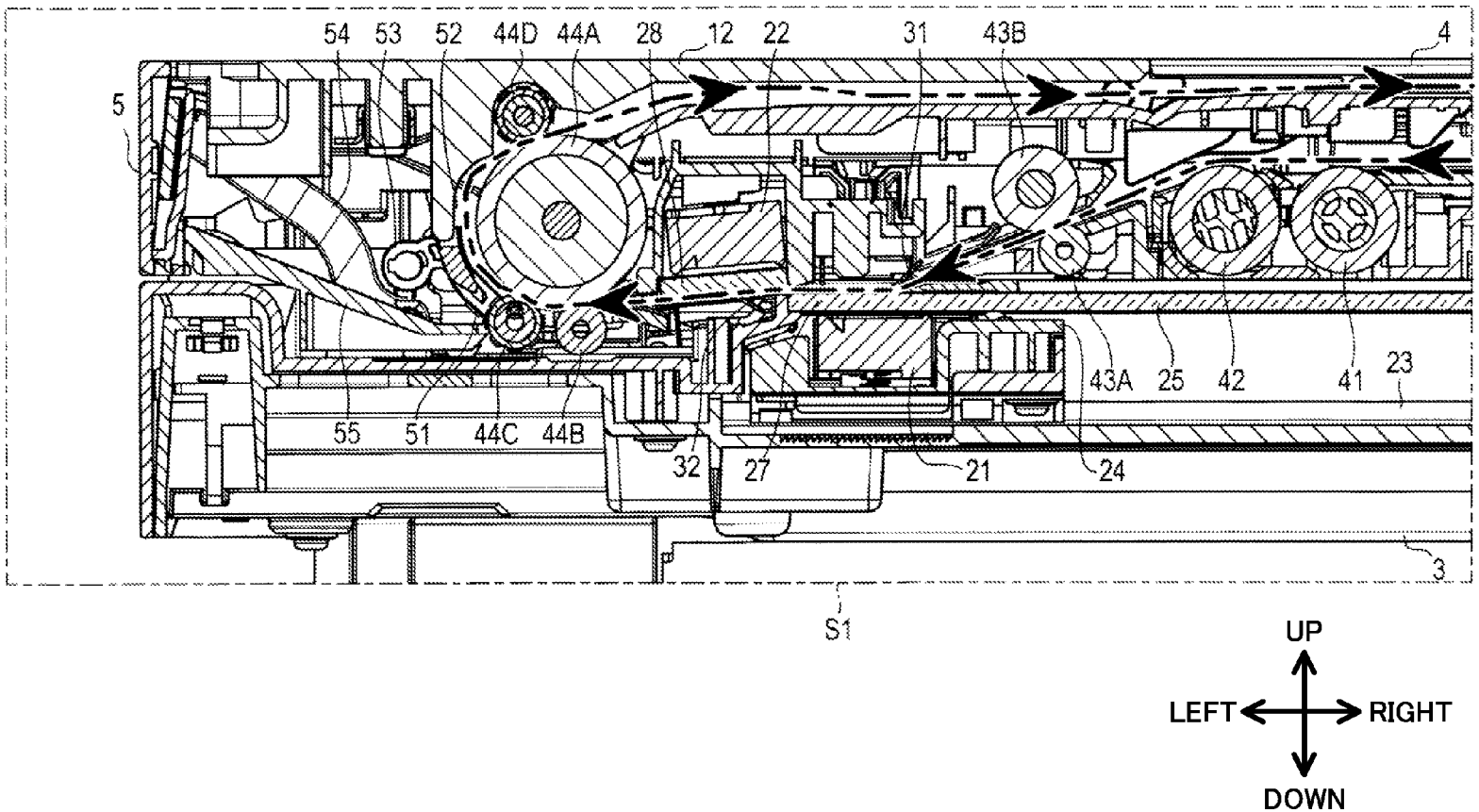
FIG. 3 is an enlarged longitudinal sectional view depicting an area S1 depicted in FIG. 2 wherein an openable portion is closed in the illustrative embodiment according to one or more aspects of the disclosure.
Figure 4:
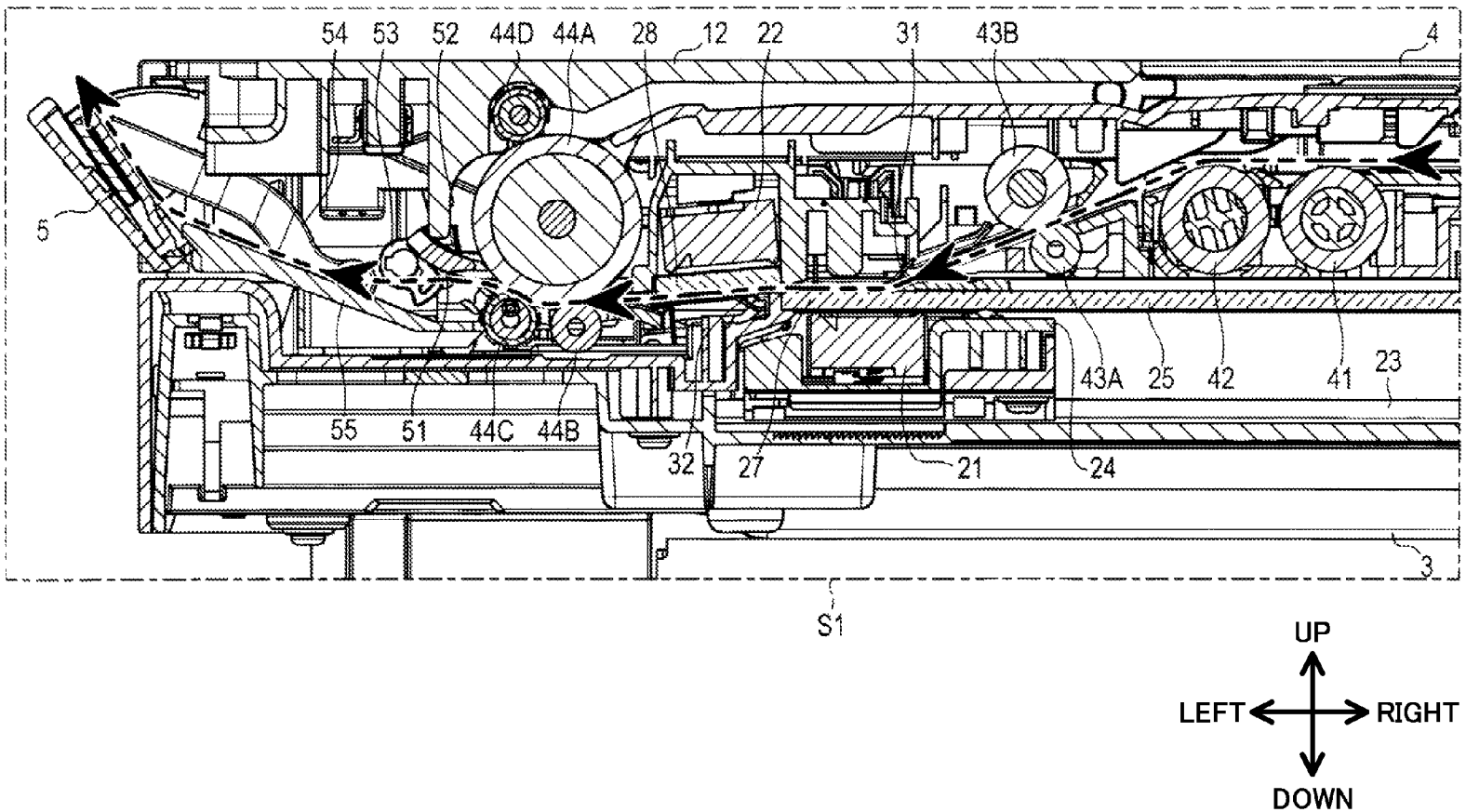
FIG. 4 is an enlarged longitudinal sectional view depicting the area S1 depicted in FIG. 2 wherein the openable portion is opened in the illustrative embodiment according to one or more aspects of the disclosure.

Next, the reading unit 3 and the document conveyor unit 4 are described in detail. As depicted in FIG. 3 and FIG. 4, the reading unit 3 may comprise a first image sensor 21, and the document conveyor unit 4 may comprise a second image sensor 22. In this illustrative embodiment, the first image sensor 21 and the second image sensor 22 may both be contact image sensors.

The first image sensor 21 may be mounted on a carriage 24 that may be configured to be movable along a guide rail 23 extending along the right-left direction. The carriage 24 may be coupled to a timing belt (not depicted) to be driven by a motor (not depicted). With this configuration, the first image sensor 21 and the carriage 24 may be configured to reciprocate along the right-left direction inside the reading unit 3. In a so-called flatbed-type image scanning, the first image sensor 21 may be configured to read an image from a document while reciprocating inside the reading unit 3. In an ADF-type image scanning, the first image sensor 21 may be configured to read an image from one side of a document while staying at a predetermined position. The second image sensor 22 may be used to read an image on an opposite side of the document in the ADF-type image scanning and be fixed to an inside frame of the document conveyor unit 4. When the multifunction peripheral 1 reads both sides of a document in the ADF-type image scanning, the first image sensor 21 may be allowed to stay at the predetermined position and the multifunction peripheral 1 may read the image on the both sides of the document by using the first and second image sensors 21, 22.

In the reading unit 3, a document receiving portion 25 and a first transparent portion 27 may be disposed above the reciprocation path of the first image sensor 21. The document receiving portion 25 may be configured to receive a document in the flatbed-type image scanning. In the ADF-type image scanning, a document may pass over the first transparent portion 27. In the document conveyor unit 4, a second transparent portion 28 may be disposed under the second image sensor 22. In the ADF-type image scanning, a document may pass under the second transparent portion 28.

The document receiving portion 25 and the first transparent portion 27 may define an upper surface of the reading unit 3. In this illustrative embodiment, a single glass plate may constitute the document receiving portion 25 and the first transparent portion 27. Another glass plate may be used for the second transparent portion 28.

Separate glass plates may be used for the document receiving portion 25 and the first transparent portion 27. Material other than glass may be used for the document receiving portion 25, the first and second transparent portions 27, 28 if the material is transparent and the first and second image sensors 21, 22 can read a document therethrough.

In the document conveyor unit 4, a first document pressing member 31 may be disposed above the first transparent portion 27. In the reading unit 3, a second document pressing member 32 may be disposed under the second transparent portion 28.

The first document pressing member 31 may be urged downward by a compression spring (not depicted) to lightly press the upper surface of the first transparent portion 27. The second document pressing member 32 may be urged upward by a compression spring (not depicted) to lightly press a lower surface of the second transparent portion 28.

The document conveyor unit 4 may comprise a plurality of rollers, for example, a supply roller 41, a separating roller 42, a pair of conveyor rollers 43A, 43B, a set of reverse rollers 44A-44D. A member functioning as a guide surface for guiding a document toward the appropriate document conveying direction may be disposed between each roller.

A first guide member 51 (an example of a guide portion) and a second guide member 52 may be disposed on the left of the reverse roller 44A, as one of the members functioning as the guide surfaces. The first guide member 51 may be configured to be pivotable with respect to the document conveyor unit 4 between a first position depicted in FIG. 3 and a second position depicted in FIG. 4. The second guide member 52 may be integral with the second upper cover 12.

A cam 53, an arm 54 (an example of a transmitting portion), and a chute 55 may be disposed on the left of the first guide member 51. The cam 53 and the arm 54 may be interposed between the openable portion 5 and the first guide member 51 with respect to the right-left direction. With this configuration, the opening or closing action of the openable portion 5 may be transmitted to the first guide member 51 and the first guide member 51 may be allowed to change its position. This movable mechanism will be described later in detail.

When the first guide member 51 is located in the first position, the first conveying path (indicated by a double-dotted and dashed line in FIG. 3) may be defined in the document conveyor unit 4. When the first guide member 51 is located in the second position, a second conveying path (indicated by a double-dotted and dashed line in FIG. 4) may be defined in the document conveyor unit 4. The second conveying path may allow a document to be conveyed with being less warped than a document to be conveyed through the first conveying path.

Figure 5:
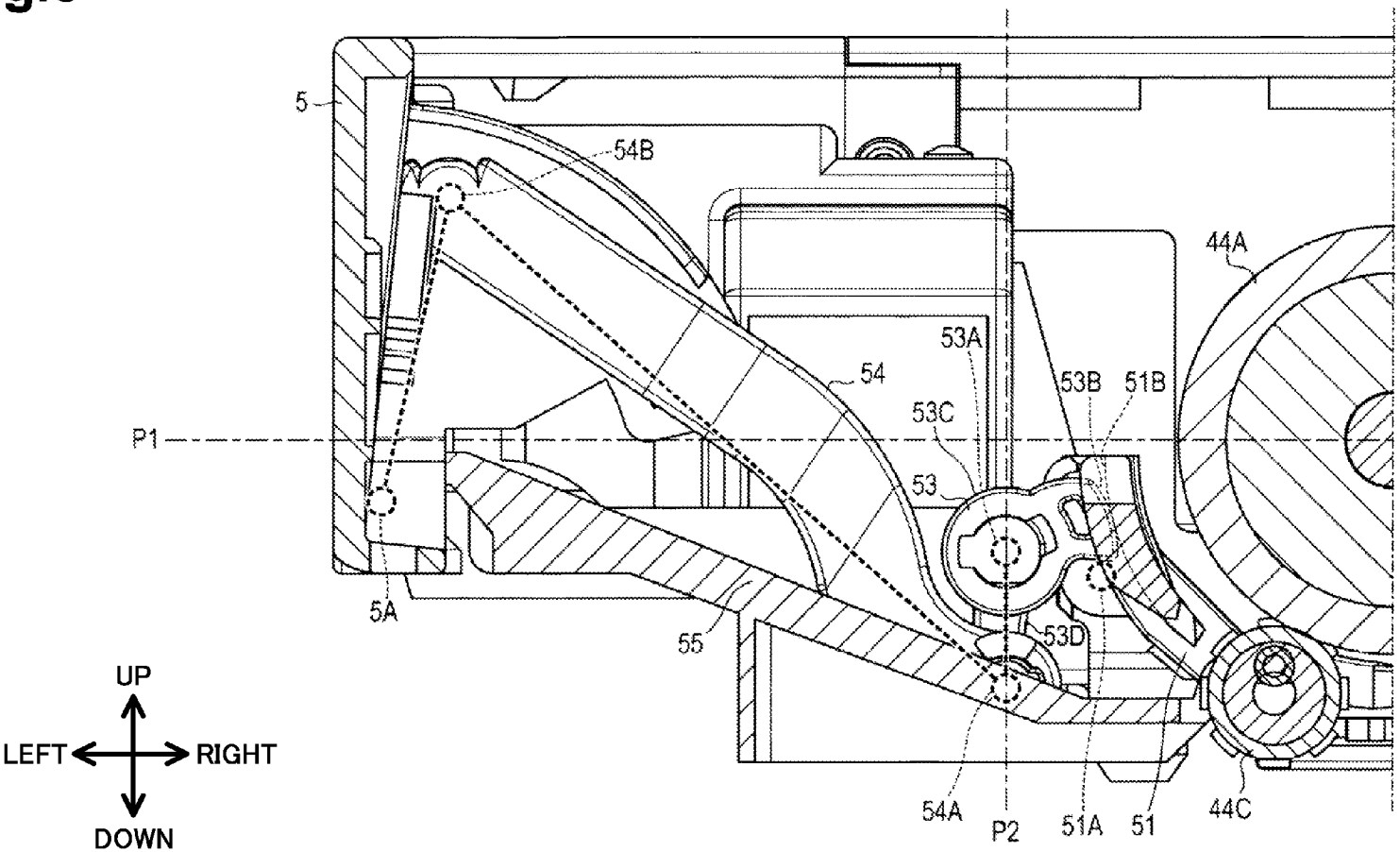
FIG. 5 is a longitudinal sectional view depicting a cam portion and a guide portion when the openable portion is closed in the illustrative embodiment according to one or more aspects of the disclosure.
Figure 6:
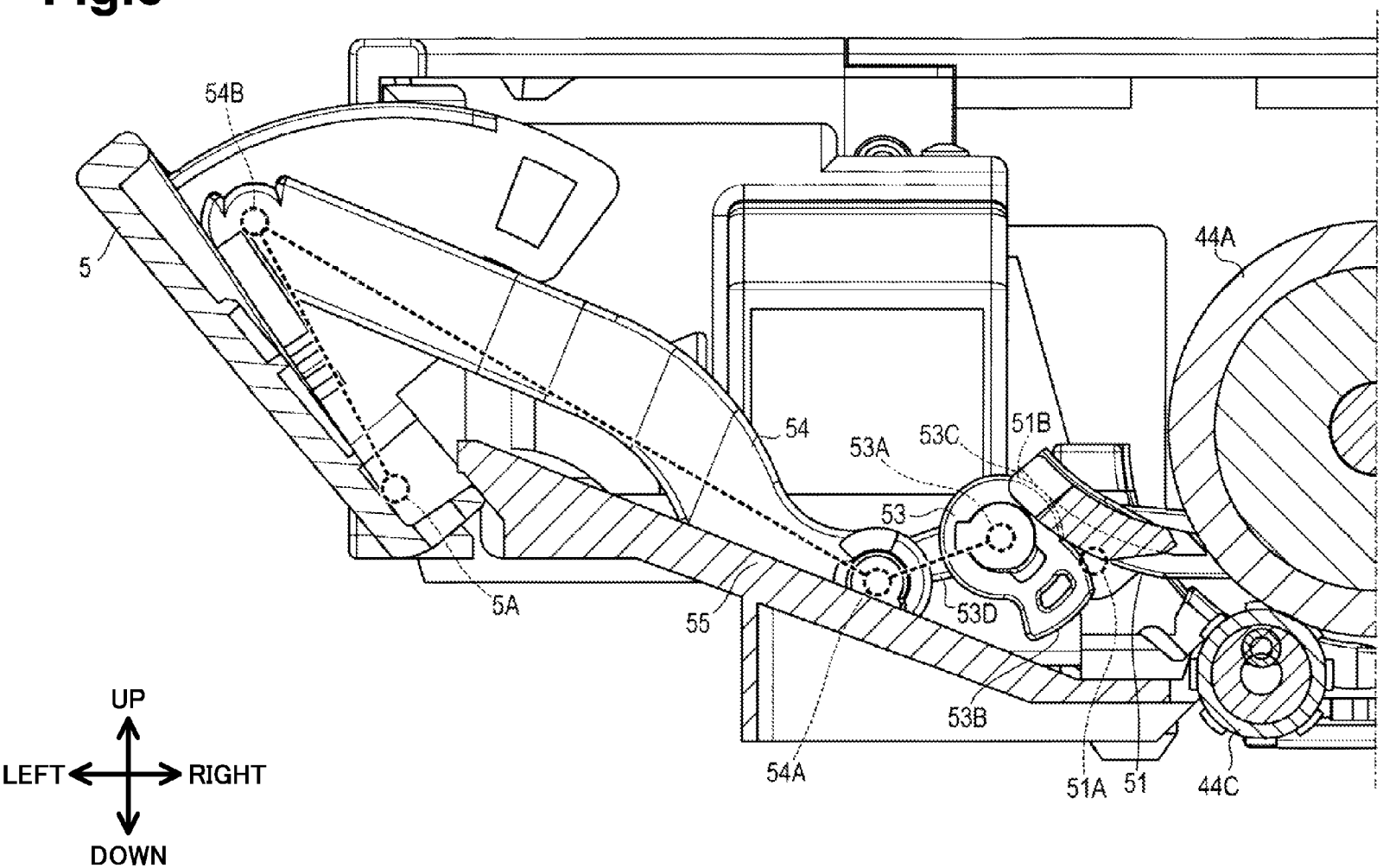
FIG. 6 is a longitudinal sectional view depicting the cam portion and the guide portion when the openable portion is opened in the illustrative embodiment according to one or more aspects of the disclosure.

As depicted in FIGS. 5 and 6, the first guide member 51 may be supported by the document conveyor unit 4 and configured to be pivotable about a pivot center 51A. The pivot center 51A of the first guide member 51 may be located below a position P1 where the rotation center of the reverse roller 44A may be located and on the right of a position P2 where a pivot center 53A of the cam 53 may be located. The first guide member 51 and the second guide member 52 may be separate parts, and the first guide member 51 may be configured to be movable independently with respect to the second guide member 52.

Therefore, a movable range of the first guide member 51 may become narrower such that the first guide member 51 may pivot compactly in a narrower space provided below the position P1 and on the right of the position P2 as compared with a guide portion having a shape and a dimension corresponding to the both of the first guide member 51 and the second guide member 52 or a guide portion having its pivot center located above the position P1, for example.

The cam 53 may be supported by a frame of the document conveyor unit 4 so as to be pivotable about the pivot center 53A. The cam 53 may comprise a first cam surface 53B and a second cam surface 53C at a circumference of the cam 53. The first cam surface 53B may extend along a direction that an axis of the pivot center 53 may extend while maintaining a constant distance from the pivot center 53A (for example, a cylindrical surface). The second cam surface 53C may also extend along the direction that the axis of the pivot center 53 may extend while maintaining a constant distance from the pivot center 53A (for example, a cylindrical surface). However, the distance between the pivot center 53A and the first cam surface 53B may be different from the distance between the pivot center 53A and the second cam surface 53C. In the illustrative embodiment, the first cam surface 53B may be located farther than the second cam surface 53C from the pivot center 53A.

The first guide member 51 may comprise a contact surface 51B on a side where the cam 53 may be provided. The contact surface 51B may be configured to be made contact with the cam 53. When the contact surface 51B is in contact with the first cam surface 53B or the second cam surface 53C, the contact surface 51B may apply its pressing force toward the pivot center 53A from the contact point between the contact surface 51B and one of the first cam surface 53B and the second cam surface 53C. With this configuration, the cam 52 may be retained on the contact surface 51B by the pressing force.

When the cam 53 is pivoted to a position where the first cam surface 53B is made contact with the contact surface 51B (see FIG. 5), the first cam surface 53B may be in contact with the contact surface 51B downstream of the pivot center 51A of the first guide member 51 with respect to the document conveying direction in the first conveying path. When the first cam surface 53B and the contact surface 51B are made contact with each other at the position described above, a force acting on the cam 53 during the sheet conveyance may be reduced as compared with a case where the first cam surface 53B may be made contact with the vicinity of the pivot center 51A of the first guide member 51.

The cam 53 may comprise an extended portion 53D that may extend in a direction that may separate from the pivot center 53A. An end part of the extended portion 53D and one end of the arm 54 may be coupled to each other such that the extended portion 53D and the arm 54 may be pivotable about a pivot center 54A. The other end of the arm 54 and the openable portion 5 may be coupled to each other such that the arm 54 and the openable portion 5 may be pivotable about a pivot center 54B.

Figure 7A:
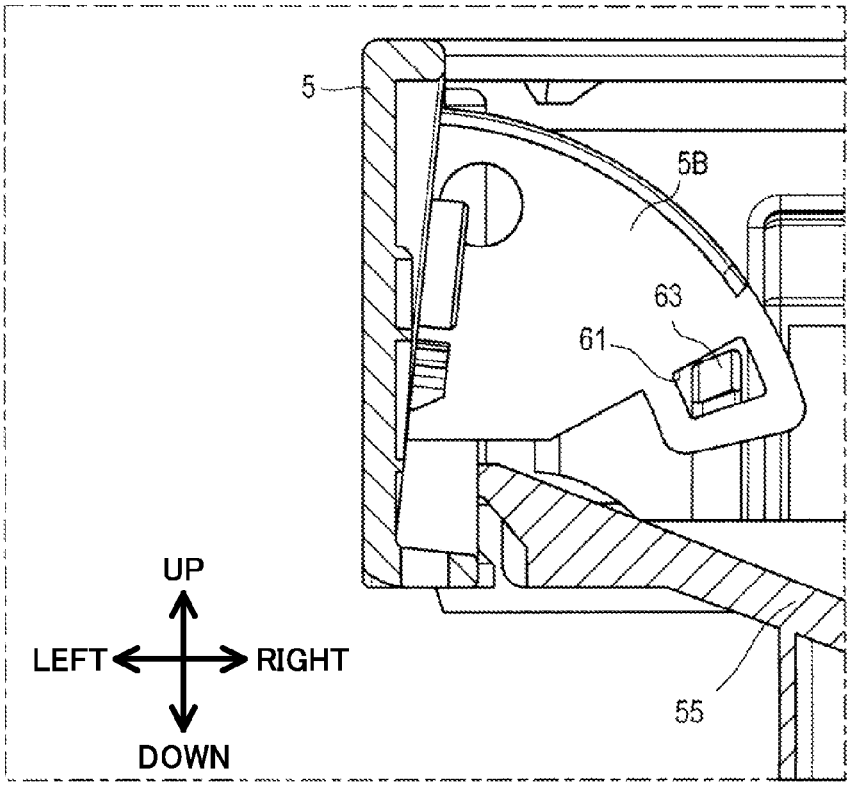
FIG. 7A is a longitudinal sectional view depicting an engagement mechanism when the openable portion is closed in the illustrative embodiment according to one or more aspects of the disclosure.
Figure 7B:
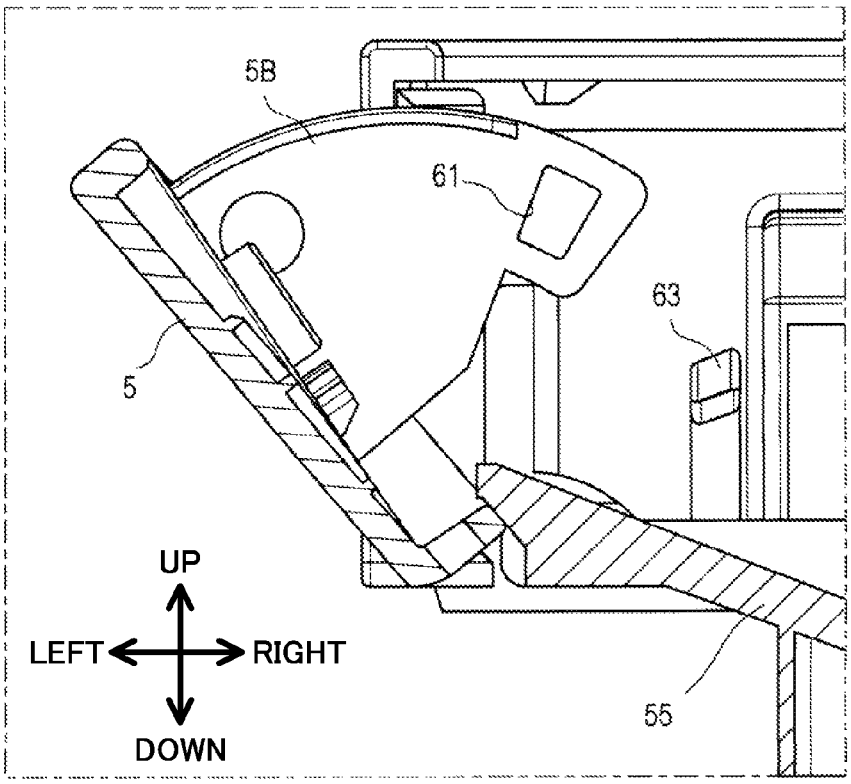
FIG. 7B is a longitudinal sectional view depicting the engagement mechanism when the openable portion is opened in the illustrative embodiment according to one or more aspects of the disclosure.

The openable portion 5 may be supported by the frame of the document conveyor unit 4 so as to be pivotable about a pivot center 5A located at lower part of the openable portion 5. As depicted in FIGS. 7A and 7B, the openable portion 5 may comprise an extended piece 5B and have an engagement opening 61. The extended piece 5B may extend rightward in FIG. 7A. The extended piece 5B may have the engagement opening 61.

As depicted in FIG. 7A, when the openable portion 5 is changed to the closed position, the engagement opening 61 may be engaged with an engaging piece 63 that may be formed with the document conveyor unit 4. With this configuration, the openable portion 5 may be retained at the closed position. The engagement of the engagement opening 61 and the engaging piece 63 may prevent the openable portion 5 from easily moving to the opened position by its own weight. The engagement of the engagement opening 61 and the engaging piece 63 may be easily released as depicted in FIG. 7B by which a user may intentionally open the openable portion 5 by hand.

Figure 8:
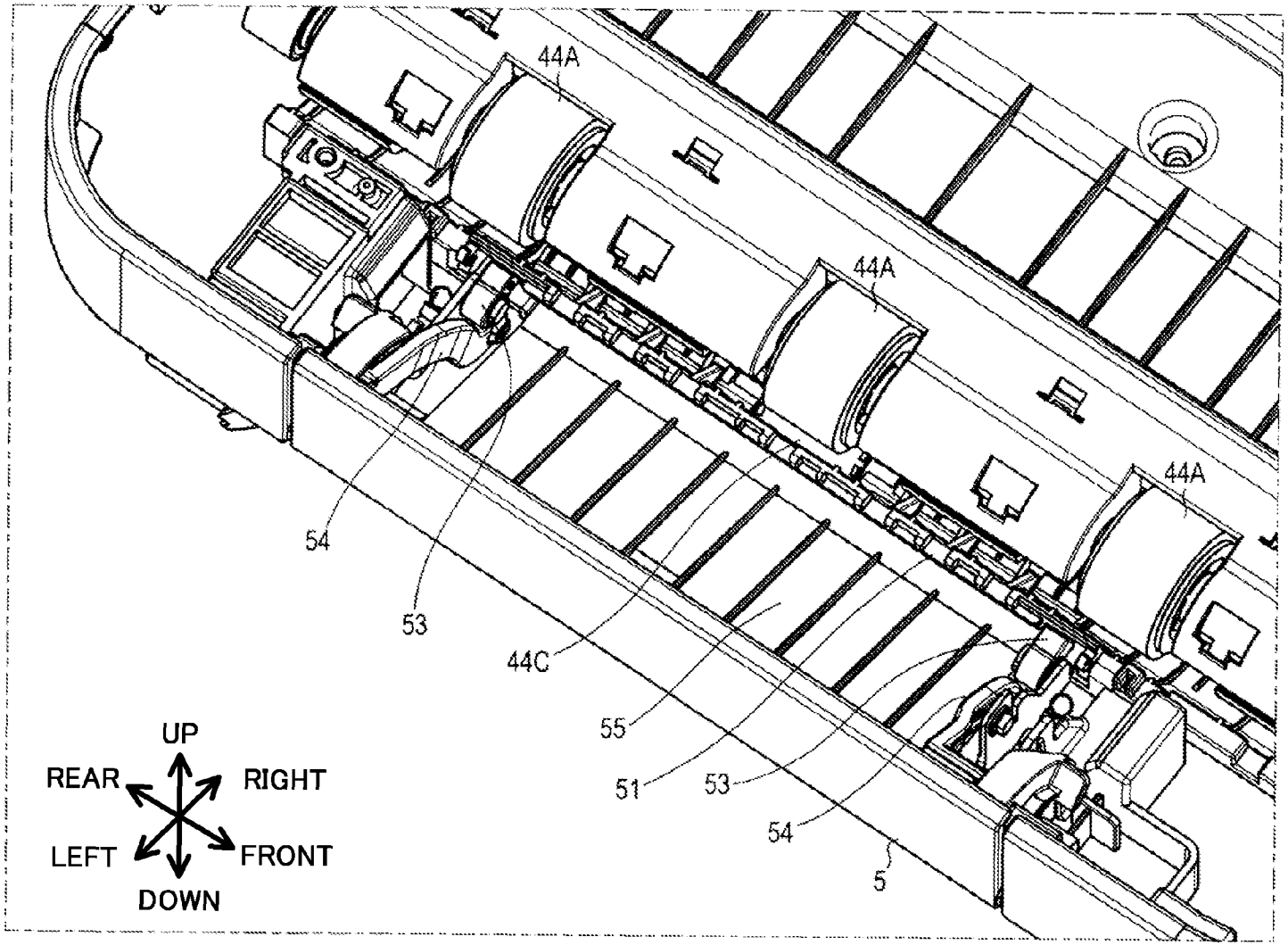
FIG. 8 is a perspective view depicting a configuration of reverse rollers and their surroundings in the illustrative embodiment according to one or more aspects of the disclosure.
Figure 9:
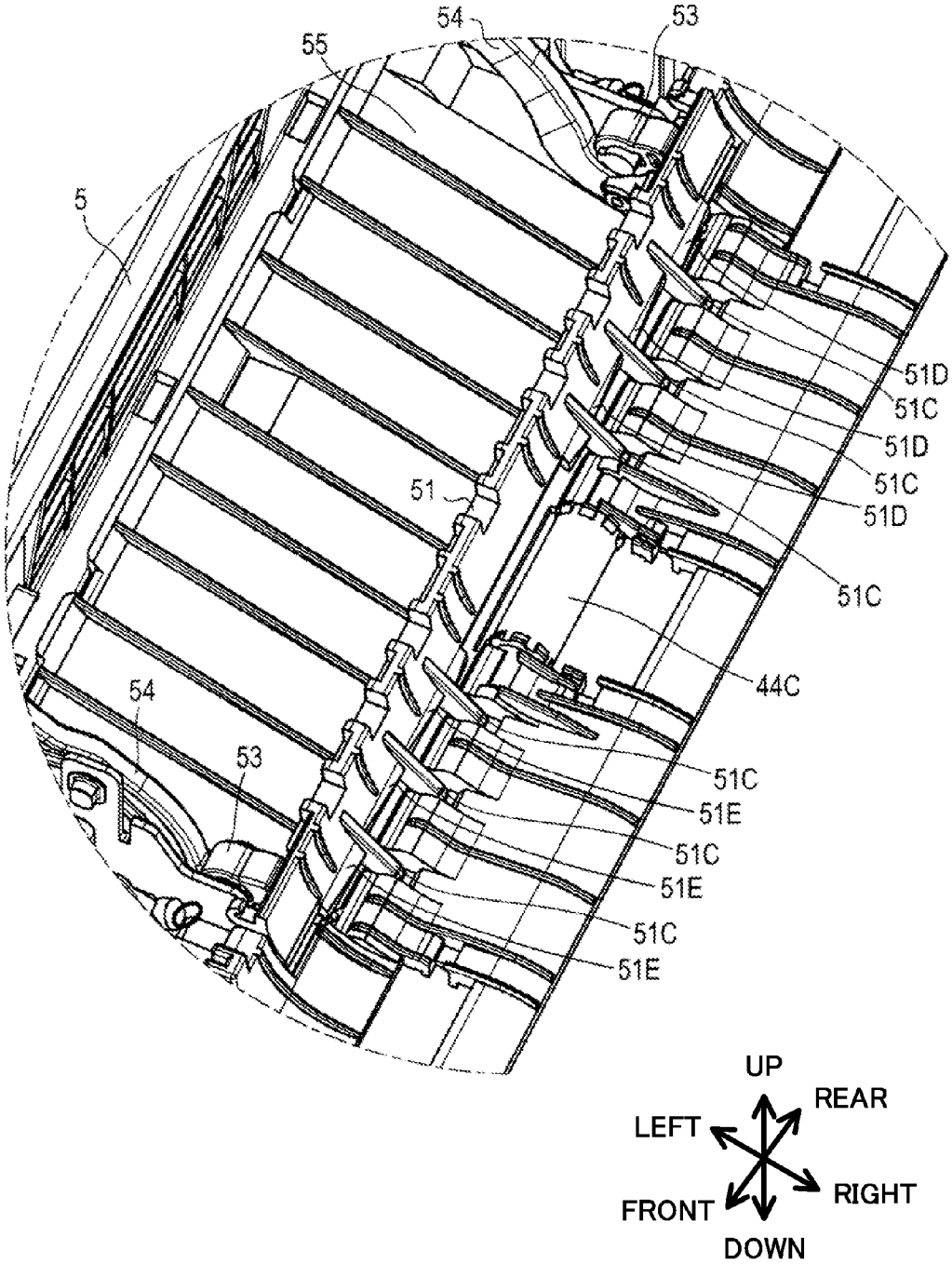
FIG. 9 is a perspective view depicting the guide portion in the illustrative embodiment according to one or more aspects of the disclosure.

As depicted in FIGS. 8 and 9, two pairs of the cam 53 and the arm 54 may be provided. One pair of the cam 53 and the arm 64 may disposed near a front end of the openable portion 5 and the other pair may be disposed near a rear end of the openable portion 5. The openable portion 5 and the first guide member 51 may both be a single member.

Figures 10A, 10B, 10C:
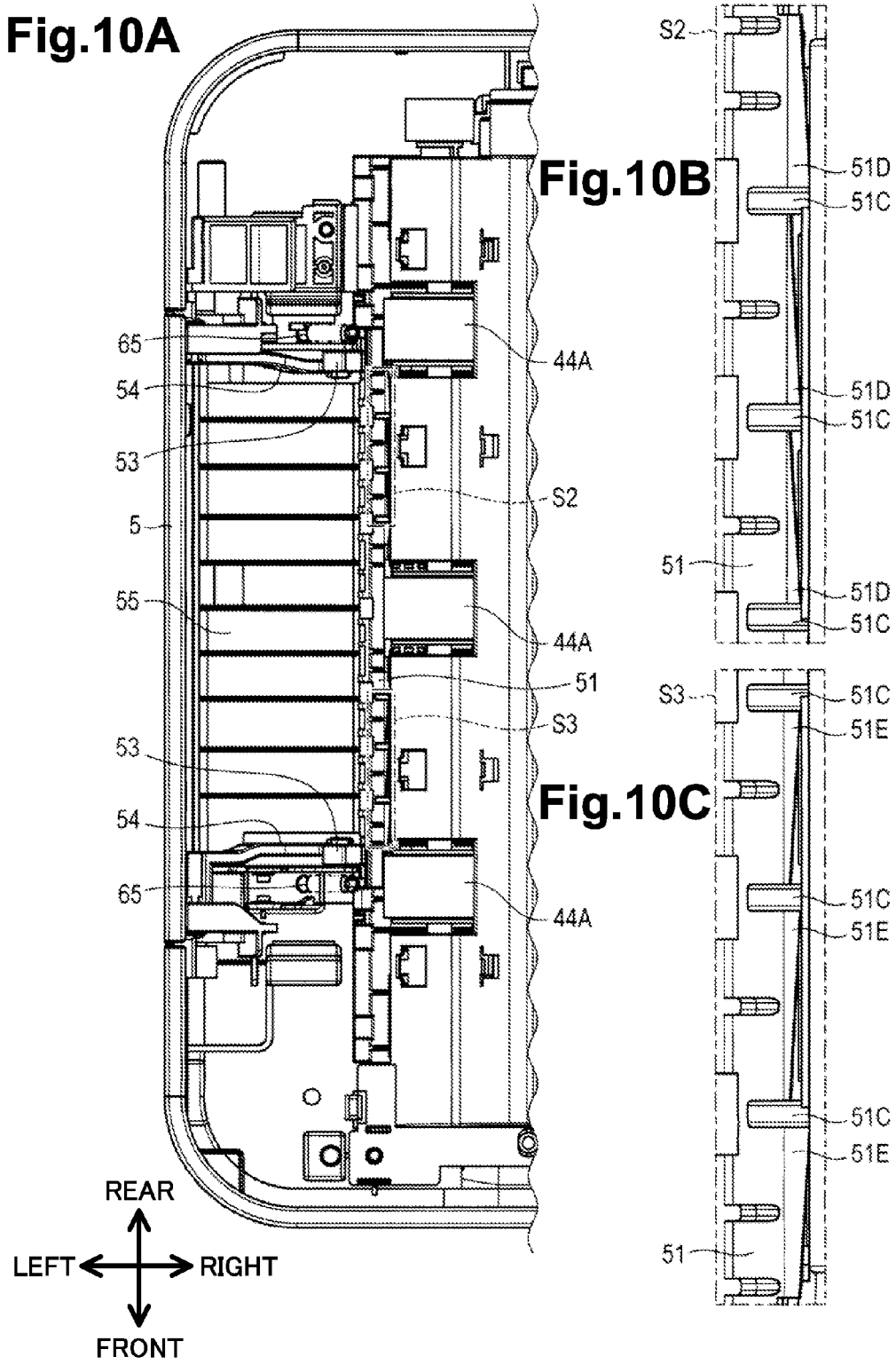
FIG. 10A is a plan view depicting a configuration of the guide portion and its surroundings in the illustrative embodiment according to one or more aspects of the disclosure.
FIG. 10C is an enlarged plan view depicting an area S3 depicted in FIG. 10C in the illustrative embodiment according to one or more aspects of the disclosure.

The first guide member 51 may comprise comb-teeth shaped portions 51C that may protrude from a lower edge of the first guide member 51. As depicted in FIGS. 9-10C, a rake face 51D or 51E may be provided near a base of each of the comb-teeth shaped portions 51. The rake face 51D may be inclined to release a leading edge of a document rearward in the drawings when the leading edge of the document contacts the rake face 51D. The rake face 51E may be inclined to release the leading edge of the document frontward in the drawings when the leading edge of the document contacts the rake face 51E. The rake face 51D may be disposed at a position near the base of each of the comb-teeth shaped portions 51C that may be disposed behind the pinch roller 44C of the set of reverse rollers 44A-44D with respect to the front-rear direction. The rake face 51E may be disposed at a position near the base of each of the comb-teeth shaped portions 51C that may be disposed in front of the pinch roller 44C with respect to the front-rear direction.

When there is a slack in a leading edge of a document and the slacking portion of the document enters between the comb-teeth shaped portions 51C, one or both of the slacking portion and a corner of the document may come into contact with one or more of the rake faces 51D, 51E. It may be difficult to release the slack in the document toward the center because the document is pinched by the middle reverse roller 44A and the pinch roller 44C disposed at the middle. There is no pinch roller 44C at positions corresponding to the side reverse rollers 44A. Therefore, the slacking portion in the leading edge of the document contacting the one or more of the rake faces 51D, 51E may be guided along the respective rake faces 51D, 51E to release the slacking portion with respect to the front-rear direction. Thus, the slack in the document may be relieved. Therefore, an occurrence of a paper jam near the rake faces 51D, 51E may be reduced as compared with a case where the inclined rake faces 51D, 51E may not be provided.

Figure 11:
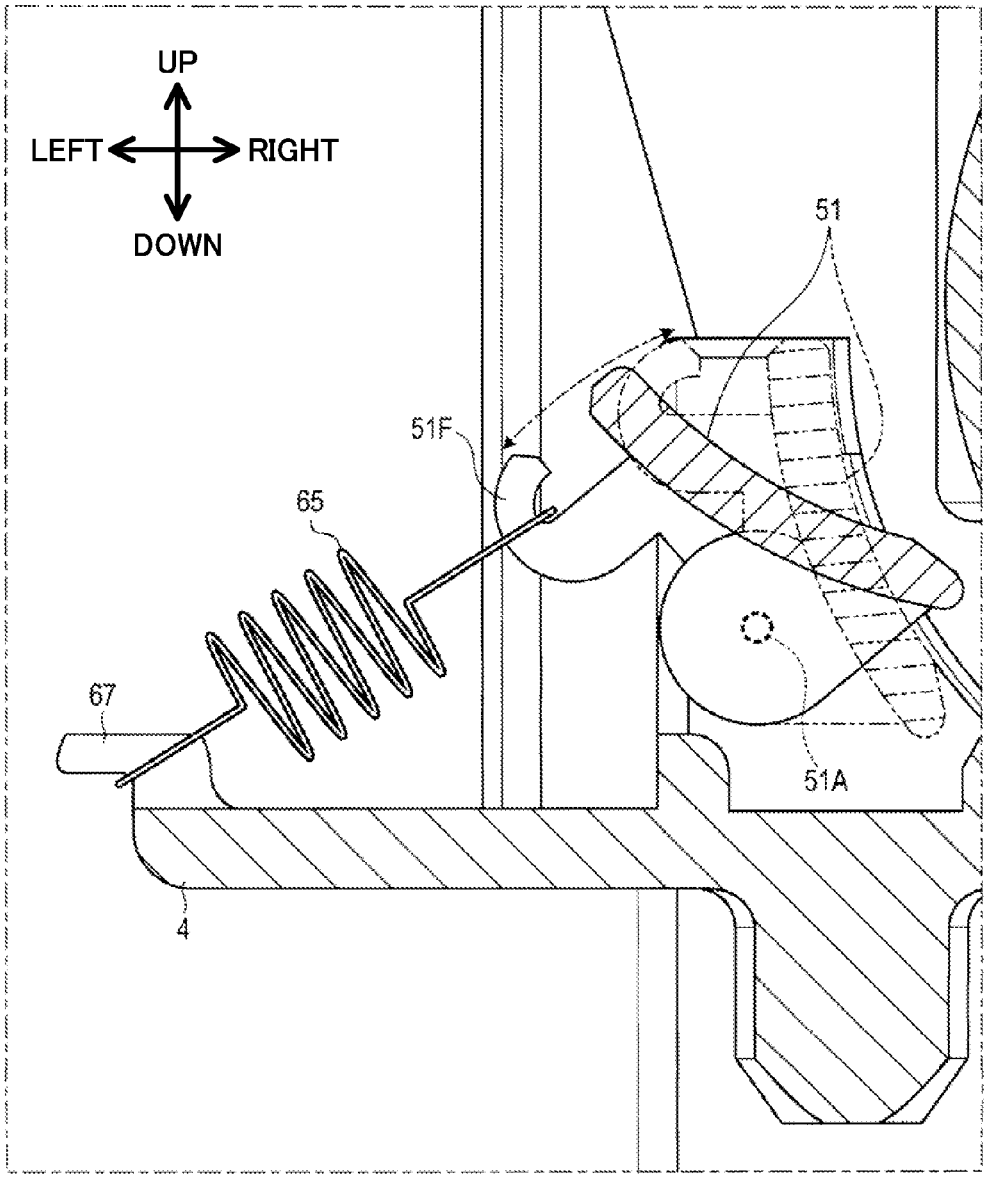
FIG. 11 is a longitudinal sectional view depicting a configuration of an urging portion and its surroundings in the illustrative embodiment according to one or more aspects of the disclosure.

As depicted in FIG. 10A, an urging member 65 may be disposed near each end of the first guide member 51 with respect to the front-rear direction. In the illustrative embodiment, each of the urging members 65 may be a tension spring. More specifically, as depicted in FIG. 11, the first guide member 51 may comprise hook portions 51F and the frame of the document conveyor unit 4 may comprise hook portions 67. The urging member 65 may be hooked on the hook portion 51F and the hook portion 67 so as to be interposed therebetween near each end of the first guide member 51. With this configuration, the first guide member 51 may be urged counterclockwise in FIG. 11.

The openable portion 5, the cam 53, and the arm 54 configured as described above may constitute a four-bar linkage (indicated by a thick dashed line in FIGS. 5 and 6). When the openable portion 5 is opened, the cam 53 may be pivoted in accordance with the opening of the openable portion 5.

The pivot center 54A, which may be a joint of the arm 54 and the cam 53, may always be located below a dead point, at which the joint of the arm 54 and the cam 53 may be stretched to the limits, when the openable portion 5 is opened or closed. Therefore, the pivot center 54A may not be allowed to reach the dead point or an opposite side with respect to the dead point by at least own weights of the arm 54 and the cam 53.

In accordance with the pivoting of the openable portion 5, the cam 53 may be changed between a state where the first cam surface 53B may be made contact with the contact surface 51B of the first guide member 51 (see FIG. 5) and a state where the second cam surface 53C may be made contact with the contact surface 51B of the first guide member 51 (see FIG. 6). When the first cam surface 53B comes into contact with the contact surface 51B (see FIG. 5), the first guide member 51 may be changed to the first position against the urging force of the urging member 65. When the second cam surface 53C comes into contact with the contact surface 51B (see FIG. 6), the first guide member 51 may be changed to the second position by the urging force of the urging member 65.

A pivot angle of the cam 53 may also be changed in accordance with the opening or closing of the openable portion 5. The first cam surface 53B and the second cam surface 53C may extend along the axis of the pivot center 53A while maintaining the constant distance, respectively, from the pivot center 53A. Therefore, the position of the first guide member 51 may not be changed although the pivot angle of the cam 53 is changed to some extent unless the first cam surface 53B or the second cam surface 53C slides over the contact surface 51 while maintaining the contact relationship with the contact surface 51B.

That is, when the openable portion 5 and the first guide member 51 are directly synchronized by the four-bar linkage, the position of the openable portion 5 and the position of the first guide member 51 may be synchronized in a one-to-one correspondence. With this configuration, the first guide member 51 may be changed from the position by the slight position change of the openable portion 5. According to the above-described configuration of the illustrative embodiment, the position of the cam 53 and the position of the first guide member 51 may not be synchronized in the one-to-one correspondence although the openable portion 5 and the cam 53 may be directly synchronized by the four-bar linkage. Therefore, the position of the first guide member 51 may not be changed by the slight position change of the openable portion 5.

Thus, if the openable portion 5 is slightly opened from the closed position, the first guide member 51 may remain at the first position. Similarly, if the openable portion 5 is slightly closed from the opened position, the first guide member 51 may remain at the second position. Although a relative positional relationship from the openable portion 5 to the cam 53 is varied within tolerances, the first guide member 51 may be appropriately positioned in the first position or in the second position without being influenced by variations in the pivot angle of the cam 53. Accordingly, a paper jam that may occur in the first conveying path or in the second conveying path due to the positional deviation of the first guide member 51 may be prevented or reduced.

Figure 12A:
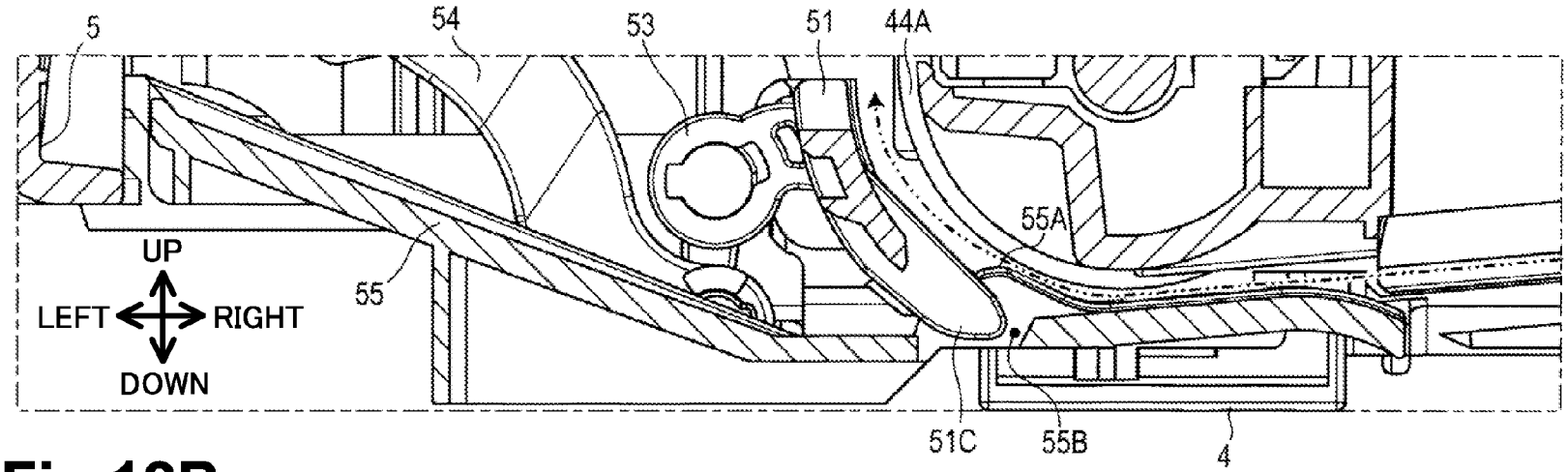
FIG. 12A is a longitudinal sectional view depicting a configuration of the guide portion located in a first position and surroundings of the guide portion in the illustrative embodiment according to one or more aspects of the disclosure.

When the first guide member 51 is located in the first position, a tip of each of the comb-teeth shaped portions 51C may enter a corresponding gap 55B between each raised portions 55A formed in the chute 55 depicted in FIG. 12A. In this state, a document being guided along the upper surface of the chute 55 may reach a position passing over the tips of the comb-teeth shaped portions 51C when the document passes over the raised portions 55A. Therefore, the document may be smoothly guided toward the downstream of the first conveying path along the first guide member 51 without being caught in the tips of one or more comb-teeth shaped portions 51C (indicated by a double-dotted and dashed line in FIG. 12A).

Figure 12B:
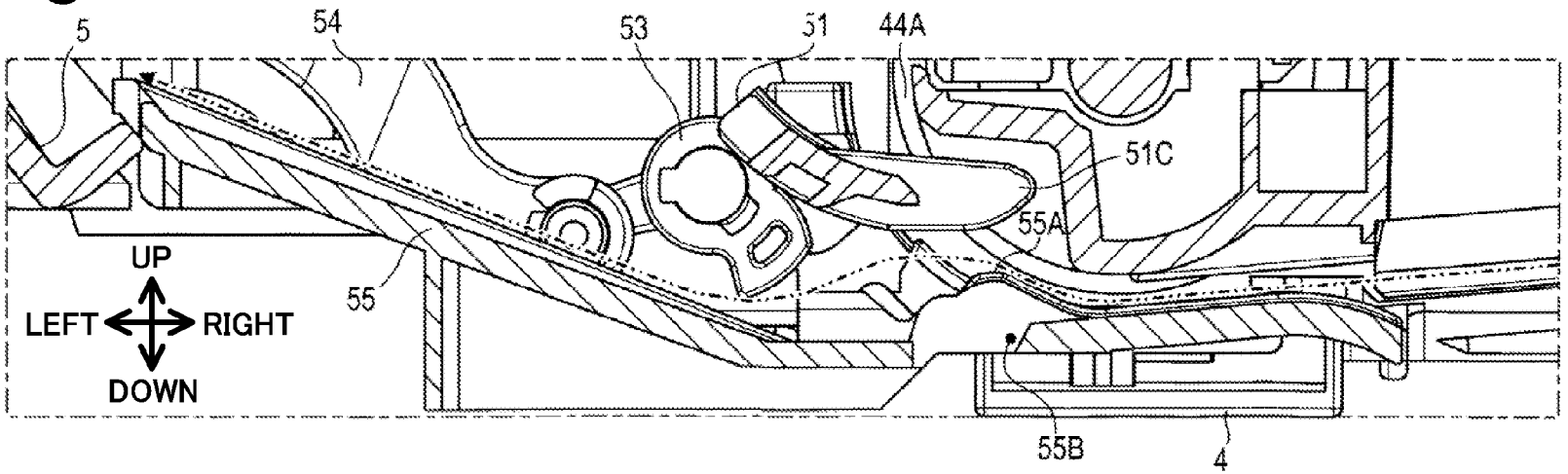
FIG. 12B is a longitudinal sectional view depicting a configuration of the guide portion located in a second position and its surrounding in the illustrative embodiment according to one or more aspects of the disclosure.

When the first guide member 51 is located in the second position, the tips of the comb-teeth shaped portions 51C may be moved to a higher position than the raised portions 55A in FIG. 12B. In this state, the document being guided along the upper surface of the chute 55 may enter the path under the comb-teeth shaped portions 51C when the document passes over the raised portions 55A. Therefore, the document may be smoothly guided toward the downstream of the second conveying path along the chute 55 without being caught in the tips of one or more comb-teeth shaped portions 51C (indicated by a double-dotted and dashed line in FIG. 12A).

An extreme end of each of the comb-teeth shaped portions 51C may be rounded and each of the comb-teeth shaped portions 51C may be tapered down from the extreme end toward the downstream with respect to the document conveying direction at both the upper and lower surfaces of each of the comb-teeth shaped portions 51C. Therefore, the tapered surfaces of each of the comb-teeth shaped portions 51C may guide the document into the appropriate conveying path when the first guide member 51 is located in the first position or in the second position.

The multifunction peripheral 1 configured as described above may be configured to read an image from a document while conveying the document by the document conveyor unit 4. At that time, the user may open or close the openable portion 5 to change the conveying path to be used between the first conveying path and the second conveying path.

The user may provide the multifunction peripheral 1 with a scan instruction to start scanning by an operation on the control panel 7 or by a remote control from a personal computer ("PC"). At that time, the user may arbitrarily specify one of a single-sided image scanning and a double-sided image scanning.

As the multifunction peripheral 1 receives the scan instruction, the multifunction peripheral 1 may allow the roller group equipped in the document conveyor unit 4 to rotate. At that time, the feed roller 41 may feed one or more documents and then the separating roller 21 may separate, one by one, the one or more documents fed from the upstream of the document conveying direction and further convey the separated sheet to the downstream of the document conveying direction.

Then, the conveyor roller pair 43A, 43B may convey the document to pass the document between the first transparent portion 27 and the first document pressing member 31. When one of the double-sided image scanning and the single-sided image scanning by the first image sensor 21 is specified in the scanning instruction, the multifunction peripheral 1 may read an image by the first image sensor 21 when the document reaches a position where the document faces the first image sensor 21.

More specifically, the front-rear direction of the multifunction peripheral 1 may correspond to a main-scanning direction. The conveying direction may correspond to a sub-scanning direction. When the document reaches the position facing the first image sensor 21, the first image sensor 21 may read an image on a first side of the document moving in the sub-scanning direction by repeatedly reading pixels arranged in the main-scanning direction on the document.

The document that has passed between the first transparent portion 27 and the first document pressing member 31 then may pass between the second transparent portion 28 and the second document pressing member 32. When one of the double-sided image scanning and the single-sided image scanning using the second image sensor 22 is specified in the scan instruction, the multifunction peripheral 1 may read an image by the second image sensor 22 when the document reaches the position facing the second image sensor 22.

More specifically, the front-rear direction of the multifunction peripheral 1 may correspond to the main-scanning direction. The conveying direction may correspond to the sub-scanning direction. When the document reaches the position facing the second image sensor 22, the second image sensor 22 may read an image on the second side of the document moving in the sub-scanning direction by repeatedly reading pixels arranged in the main-scanning direction on the document.

Then, the document that has passed between the second transparent portion 28 and the second document pressing member 32 may reach the reverse rollers 44A and may be further conveyed toward the left of the reverse roller 44A from a lower end of the reverse roller 44A.

When the first conveying path is selected to be used (see FIG. 3), the first guide member 51 may be located in the first position and may serve as a wall that may partition a space into a right space and a left space provided on both sides of the first guide member 51. A right side-surface of the first guide member 51 may be a concave surface. In this state, the concave surface of the first guide member 51 may be located along a perimeter of the reverse roller 44A and may function as a guide surface that may guide a leading edge of a document upward when the document is conveyed from the lower end of the reverse roller 44A toward the left.

The document that is guided upward along the guide surface may be substantially U-turned along the reverse roller 44A, and thus, may be conveyed along the first conveying path. The document that was guided along the first conveying path may be discharged onto the upper surface of the document conveyor unit 4 (the upper surfaces of the partitions 15 depicted in FIG. 2).

When the second conveying path is selected to be used (see FIG. 4), the first guide member 51 may be located in the second position. In this state, the right space and the left space provided on the both sides of the first guide member 51 may be joined. Thus, the leading edge of the document may pass under the first guide member 51 when the document is further conveyed from the lower end of the reverse roller 44 toward the left. As a result, the document may be conveyed toward the openable portion 5 along the second conveying path. Therefore, the user may determine whether a document is to be conveyed along the first conveying path or the second conveying path in accordance with the size or thickness of the document to be read. When the user determines to use the second conveying path, the user may move the openable portion 5 to the opened position. With this pivoting, the first guide member 51 may be allowed to move to the second position.

In addition, the multifunction peripheral 1 may be configured to read an image from a document while the document is placed on the document receiving portion 25. When the multifunction peripheral 1 reads the image as described above, first, the document conveyor unit 4 may be opened and a document may be placed on the document receiving portion 25. Under this condition, the multifunction peripheral 1 may be provided with a scan instruction by an operation on the control panel 7 or by remote control from the PC (not depicted).

When the multifunction peripheral 1 receives a scan instruction, first, the multifunction peripheral 1 may perform a process for initializing each portion or each unit of the multifunction peripheral 1. Then, the multifunction peripheral 1 may read an image from the document by the first image sensor 21. More specifically, the front-rear direction of the multifunction peripheral 1 may correspond to the main-scanning direction. The right-left direction may correspond to the sub-scanning direction. The first image sensor 21 may read an image on the first or second side of the document placed on the document receiving portion 25 by repeatedly reading pixels arranged in the main-scanning direction on the document while moving in the sub-scanning direction together with the carriage 24.

While the disclosure has been described in connection with various example structures and illustrative embodiment, it will be understood by those skilled in the art that other variations and modifications of the structures and embodiments described above may be made without departing from the scope of the disclosure. Other structures and embodiments will be apparent to those skilled in the art from a consideration of the specification or practice of the disclosure disclosed herein.

Figure 13A:
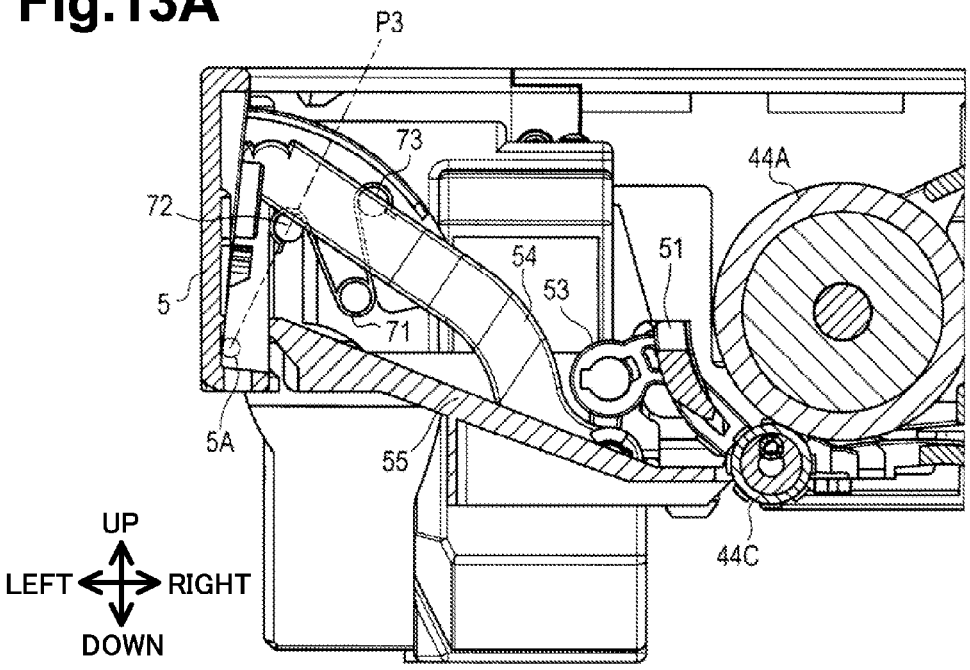
FIG. 13A is a longitudinal sectional view depicting the openable portion that is being urged to the closed position by a coil torsion spring in an another illustrative embodiment according to one or more aspects of the disclosure.
Figure 13B:
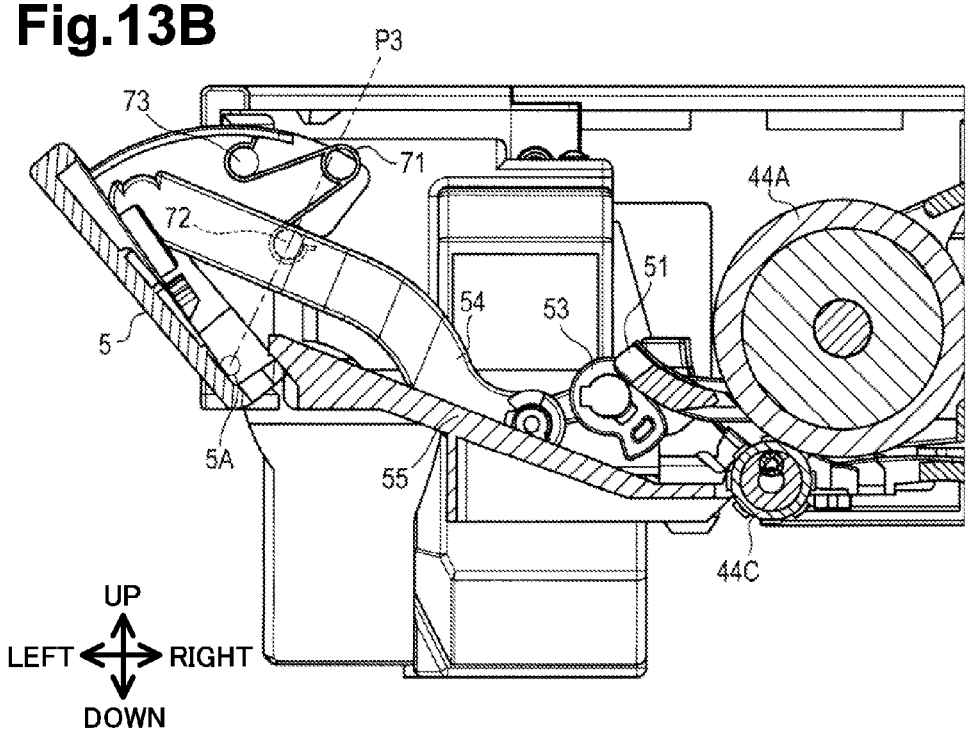
FIG. 13B is a longitudinal sectional view depicting the openable portion that is being urged to the opened position by the coil torsion spring in the another illustrative embodiment according to one or more aspects of the disclosure.

In the above-described illustrative embodiment, the openable portion 5 may be retained in the closed position by the engagement opening 61 and the engaging piece 63. Nevertheless, in other embodiment, for example, as depicted in FIGS. 13A and 13B, a coil torsion spring 71 may be used to retain the openable portion 5 in the opened position or in the closed position.

In this case, in the coil torsion spring 71, one end may be coupled to a pivot center 72 provided at the frame of the document conveyor unit 4 so as to be pivotable about the pivot center 72 and the other end may be coupled to a pivot center 73 provided at the openable portion 5 so as to be pivotable about the pivot center 73. When the openable portion 5 is opened or closed, the pivot center 73 may turn around a pivot center of the openable portion 5 but the pivot center 72 may not be moved from the position. Accordingly, the coil torsion spring 71 may pivot about the pivot center 72. At that time, a distance between the pivot center 72 and the pivot center 73 may be changed. Thus, the coil torsion spring 71 may pivot while the distance between the pivot center 72 and the pivot center 73 is changed.

The distance between the both ends of the coil torsion spring 71 may become the shortest when the pivot center 73 pivoting together with the openable portion 5 is located on a straight line P3 that may pass both of the pivot center 5A and the pivot center 72. In this state, the coil torsion spring 71 may be twisted the most.

Therefore, when the pivot center 73 is moved to the left of the straight line P3, the coil torsion spring 71 may urge the pivot center 73 in a direction that may release its twist and the openable portion 5 may be urged to the opened position by the urging force. When the pivot center 73 is moved to the right of the straight line P3, the coil torsion spring 71 may also urge the pivot center 73 in a direction that may release its twist. In this case, the openable portion 5 may be urged to the closed position by the urging force.

That is, the openable portion 5 may be urged toward one of the opened position and the closed position in accordance with a positional relationship between the pivot center 73 and the straight line P3. Therefore, similar to the above-described illustrative embodiment, the openable portion 5 may be retained in the closed position by using such a coil torsion spring 71. In addition, the openable portion 5 may be retained in the opened position.

In the above-described illustrative embodiment, the urging members 65 may be provided to move the first guide member 51 to the second position. However, the urging members 65 may not be necessarily provided. In other embodiments, for example, the urging member 65 may be omitted when the first guide member 51 is configured to move to the second position by its own weight. In the above-described illustrative embodiment, the tension springs may be adopted to the urging members 65. Nevertheless, in other embodiments, for example, compression springs or torsion springs may be adopted to the urging members 65 as well as the tension springs. In still other embodiments, for example, a resin spring may be used instead of the metal spring. The urging members 65 may be configured to be pulled or urged by magnetic force.

In the above-described illustrative embodiment, the arm 54 may be provided as a member that may transmit the motion of the openable portion 5 to the cam 53. Nevertheless, in other embodiments, for example, a motion transmission mechanism (for example, a gear mechanism), which may be different from the arm 54, may be interposed between the openable portion 5 and the cam 53 to transmit the motion of the openable portion 5 to the cam 53. However, the arm 54 according the illustrative embodiment may implement the four-bar linkage by using the openable portion 5 and the cam 53. Accordingly, the cam 53 may be pivoted between the appropriate two positions with a relatively small parts count.

In the above-described illustrative embodiment, the first guide member 51 may be configured to be positioned in the second position by which the first guide member 51 may be made contact with the second cam surface 53C. Nevertheless, in other embodiments, for example, the first guide member 51 may be configured to be positioned in the second position by which the first guide member 51 may be made contact with another portion other than the cam 53.

In the above-described illustrative embodiment, the sheet conveyor device that may serve as the automatic document feeder equipped in the image-reading device may be described as an example of the sheet conveyor device of the disclosure. The sheet conveyor device of the disclosure may function as a conveyor mechanism that may be configured to convey a recording medium and equipped in an image forming apparatus.

More specifically, for example, a feeding path extending from a sheet feed cassette may serve as the first conveying path, and a feeding path extending from a manual feed tray may serve as the second conveying path. An openable portion may be disposed at a feed port into which a sheet may be fed from the manual feed tray. When the openable portion is opened or closed, the conveying path may be changed in accordance with the opening or closing of the openable portion.

In the above-described illustrative embodiment, the multifunction peripheral 1 having various functions (for example, one or more of the printing function, the copying function, and the facsimile data transmitting/receiving function) as well as the function of the image-reading device (the scanning function) may be described as an example. The number of functions that the multifunction peripheral 1 may have as well as the scanning function may be arbitrarily determined Aspects of the disclosure may be adopted in, for example, a single-function image reading device having a scanning function.

What is claimed is:

1. A sheet conveyor device, comprising:

a conveyor configured to convey a sheet;

a first portion configured to be moved;

a cam configured to pivot about an axis in response to movement of the first portion, and comprising a first cam surface that extends along a direction of the axis while maintaining a constant distance from the axis; and a guide portion configured to be movable between a first position and a second position, in response to movement of the cam, to choose a first or second conveying path for the sheet, wherein when the guide portion is in the first position, the guide portion is in contact with the first cam surface, wherein the first cam surface allows the cam to be rotated a predetermined amount without causing the guide portion to move between the first and second positions.

2. The sheet conveyor device according to claim 1, further comprising an urging member configured to urge the guide portion toward the second position, wherein the cam allows the guide portion to locate in the first position against an urging force of the urging member when the first cam surface is located in the position where the first cam surface is in contact with the guide portion.

3. The sheet conveyor device according to claim 1, wherein the cam further comprises a second cam surface that extends along the direction of the axis while maintaining a constant distance, which is different from the constant distance between the first cam surface and the axis, from the axis, and is configured to retain the guide portion in the second position when the cam is located in a position where the second cam surface is in contact with the guide portion.

4. The sheet conveyor device according to claim 1, wherein the guide portion comprises a guide surface configured to allow the sheet being conveyed along the first conveying path to move from upstream to downstream in a conveying direction when the guide portion is located in the first position, and wherein the cam is further configured to contact the guide portion at a position closer to a downstream end of the guide surface than an axis of the guide portion.

5. The sheet conveyor device according to claim 1, wherein the sheet conveyor device is configured to convey the sheet through the second conveying path with the sheet to be less warped than the sheet to be conveyed through the first conveying path.

6. The sheet conveyor device according to claim 5, wherein the first conveying path comprises a curved part in which the sheet conveyor device conveys the sheet from upstream to downstream while causing the sheet to become warped, and wherein the guide portion is disposed upstream of the curved part of the first conveying path and configured to allow the sheet to move along the curved part of the first conveying path.

7. The sheet conveyor device according to claim 6, wherein the conveyor comprises a conveyor roller that is disposed on a side opposite to a side where the guide portion is disposed while interposing the conveying path therebetween and configured to contact the sheet by a circumference of the conveyor roller curving along the curved part, and wherein the guide portion is configured to be pivotable about an axis located below a rotation axis of the conveyor roller with respect to an up-down direction.

8. The sheet conveyor device according to claim 1, wherein the first portion is configured to:

cause the cam to move;

block a part of the second conveying path when the first portion is in a first position; and define a part of the second conveying path when the first portion is in a second position.

9. The sheet conveyor device of claim 1, wherein the first cam surface causes the guide portion to move between the first and second positions when the cam is rotated beyond the predetermined amount.

10. The sheet conveyor device of claim 1, wherein the cam and the first portion are interlocked.

11. The sheet conveyor device of claim 1, wherein the first portion is a transmission arm interlocked with a cover.

12. The sheet conveyor device of claim 11, wherein the cover defines a part of the second conveying path.

13. The sheet conveyor device of claim 1, wherein the cam includes an extended portion coupled to the first portion via a second axis.

14. The sheet conveyor device of claim 1, wherein the cam has a cross-section in the shape of a circle with a protrusion corresponding to the first cam surface.

15. The sheet conveyor device of claim 14, wherein the cross-section of the protrusion is curved in an upstream direction.

* * * * *